US007404694B2

(12) United States Patent
Kovári

(10) Patent No.: US 7,404,694 B2
(45) Date of Patent: Jul. 29, 2008

(54) METHOD AND DEVICE FOR STABILIZING A CAVITY EXCAVATED IN UNDERGROUND CONSTRUCTION

(76) Inventor: Kalman Kovári, Burenweg 34, CH-8053 Zürich (CH)

( * ) Notice: Subject to any disclaimer, the term of this patent is extended or adjusted under 35 U.S.C. 154(b) by 163 days.

(21) Appl. No.: 11/052,221

(22) Filed: Feb. 8, 2005

(65) Prior Publication Data

US 2005/0191138 A1 Sep. 1, 2005

(30) Foreign Application Priority Data

Feb. 16, 2004 (EP) ..... 04405086

(51) Int. Cl.
*E21D 11/05* (2006.01)

(52) U.S. Cl. ..... 405/153; 405/135; 405/263

(58) Field of Classification Search ..... 405/134, 405/135, 146, 150.1, 151–153, 263, 266, 405/268, 287.1

See application file for complete search history.

(56) References Cited

U.S. PATENT DOCUMENTS 2,230,032 A * 1/1941 Freyssinet ..... 405/153
5,992,118 A * 11/1999 Wagner et al. ..... 52/592.2
2003/0154683 A1 * 8/2003 Bache ..... 52/586.1

FOREIGN PATENT DOCUMENTS

| | | |
|---|---|---|
| DE | 197 16 514 C1 | 6/1998 |
| WO | WO 99/28162 A1 | 6/1999 |
| WO | WO 00/55567 A1 | 9/2000 |

OTHER PUBLICATIONS

Usdoe, Kremer et al., Oct. 20, 2004, "Development of Steel Foam Materials", entire document.*

* cited by examiner

*Primary Examiner*—Tara L. Mayo
(74) *Attorney, Agent, or Firm*—Oliff & Berridge, PLC

(57) ABSTRACT

A compression body is inserted into the contraction joint between two tunnel lining elements, which body deforms in response to a compressive load caused by the tunnel lining elements moving towards each other. The compression body is composed of a material containing voids, and has a compressive strength of at least 1 MPa and a void fraction of between 10% and 90% of its total volume. The compression body may be composed, for example, of steel foam, or of a mixture which contains cement and blown-glass particles or plastic particles.

When a predetermined compressive load is exceeded, the voids within the compression body collapse in a stepwise manner, or are compressed in a stepwise manner.

22 Claims, 5 Drawing Sheets

METHOD AND DEVICE FOR STABILIZING A CAVITY EXCAVATED IN UNDERGROUND CONSTRUCTION

BACKGROUND

The exemplary embodiments of the present invention relates to a method and a device for stabilizing a cavity excavated in underground construction. This method and this device are preferably applied in poor rock which exerts pressure but has little strength.

In underground structures (tunnels, galleries, caverns, and the like), a known procedure is to secure the excavated cavity using a lining, i.e., using supporting means such as steel arches, gunned concrete, anchors, and prefabricated concrete elements (tubing). In poor pressure-exerting rock of low strength, the profile of the excavated cavity has a tendency to narrow. This results in forces acting on the lining which generate compressive stresses in the supporting means. The known supporting means under these circumstances are therefore designed so a to be able to give way. As a result of this giving-way action, the pressure of the rock generally subsides.

Publication EP-B-1 034 096 is the most obvious prior art here which shows and describes a tunnel lining which has at least two lining elements acting as supporting segments which are separated by a contraction joint running longitudinally within the tunnel. Upset tubes have been placed into these contraction joints, each of which is located between an outer and inner upset tube and mounted at their faces between two pressure-transfer plates. Pressure is transferred through these pressure plates from the lining segments onto each upset tube. At a given axial load exceeding the buckling resistance of the upset tube, the upset tube buckles in stages and becomes shorter. While overcoming a resistance in the circumferential direction of the tunnel, the lining segments are able to move towards each other and simultaneously exert a resistance of the structure against the rock.

This known tunnel lining has certain practical disadvantages. In the area of the faces of the upset tubes, a local concentration of stress occurs in the lining segments. As a result, other measures must be taken beyond the installation of the pressure transfer plates in order to preclude the lining segments from sustaining damage due to this concentration of stress. This action is disadvantageous in terms of cost. In the case of a lining composed of gunned concrete, the contraction joint must additionally be protected during production of the lining against penetration by the gunned concrete. In addition, problems may arise from a possible tilted position of the upset tubes due to transverse movements by the lining segments relative to each other.

SUMMARY

The goal of the invention is therefore to create a method and a device of the type referenced in the introduction which provides a simpler and more cost-effective approach by which a predetermined resistance is able to oppose the pressure exerted on the supporting means by allowing deformations to occur.

This goal is achieved according to the invention by a method, a device or a compression body usable with the device.

The voids for the compression body inserted in a targeted manner during production, which body is inserted into the force flow coming from the deforming rock, are reduced in size in a stepwise manner upon exceeding a predetermined pressure load. This reduction of the voids is implemented in a metal-based compression body by stepwise compression, in a cement-based compression body by a stepwise collapse of the voids. This reduction of the voids in connection with the deformation of the base material of the compression body allows for considerable relative motion within the supporting means. As a result, there is no lateral deformation, or only a slight deformation relative to the compression, of the compression body—an advantageous property in the case of certain applications. The void fraction relative to the total volume of the compression body is a factor determining the body's maximum compressibility and its resistance to compression.

The dimensions and mechanical properties of the compression body can be very easily adapted to the specific requirements. For example, the compression body can be designed as an extended structure running perpendicular to the active compression forces so as to avoid the danger of stress concentrations within the supporting means.

Preferred further embodiments of the method according to the invention, of the device according to the invention, and of the compression body according to the invention are discussed herein.

BRIEF DESCRIPTION OF THE DRAWINGS

The following discussion explains embodiments of the invention in more detail based on the figures. These purely schematic drawings are as follows.

EMBODIMENTS

Figure 2:
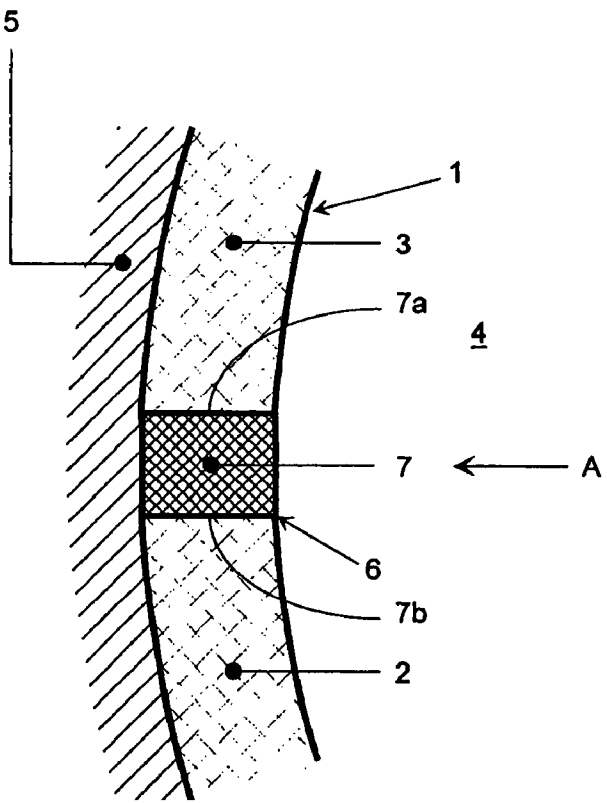
FIG. 2 shows a section along a line II-II in FIG. 1.
Figure 1:
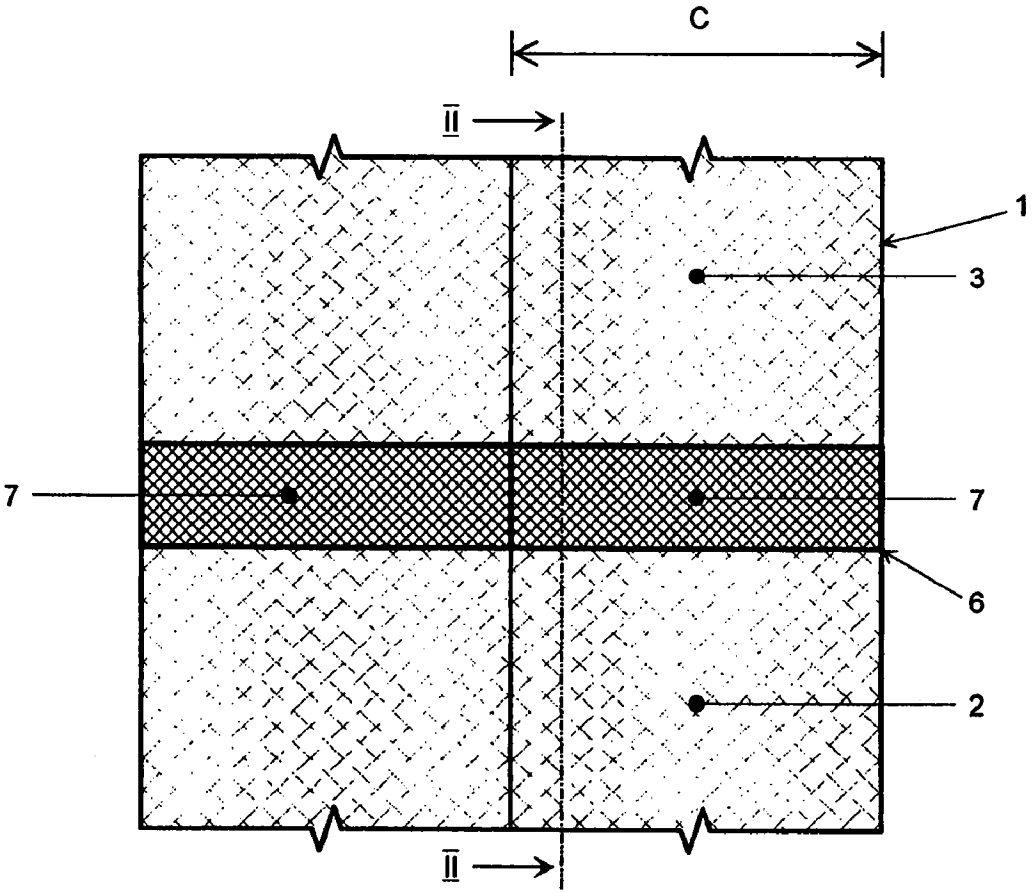
FIG. 1 is a view of a region of a first embodiment of a tunnel lining in the direction of arrow A in FIG. 2.

The tunnel lining 1, regions of which are shown in FIGS. 1 and 2, is composed of two tunnel lining elements 2 and 3 acting as supporting means. Arrow C points to the last stage of the lining. Tunnel lining elements 2, 3, which are produced out of gunned concrete, in-situ concrete or prefabricated concrete elements, accommodate the pressure exerted by deformations in the rock 5 surrounding tunnel cavity 4. Tunnel lining elements 2, 3 are separated by a space 6 (contraction joint) running lengthwise in the tunnel. Longitudinal compression bodies 7 are located in this space 6 and fill space 6 almost completely. Compression bodies 7 preferably are of a length which matches the length of installation stage C.

Each compression body 7 is composed of a material having a predetermined volume fraction of voids which are distributed throughout entire compression body 7. These voids are introduced in a targeted manner during fabrication of compression body 7. Compression body 7 specifically has a compressive strength of at least 1 MPa, and a void fraction of between 10% and 90% of the total volume. Preferably, however, compression body 7 has a compressive strength of at least 3 MPa, and a void fraction of between 20% and 70%. Compression bodies 7 should be able to withstand a predetermined compressive load, yet undergo a relatively large deformation when a predetermined compressive load is exceeded. This deformation occurs principally by the voids' collapsing in stepwise fashion or compressing in stepwise fashion.

The voids of compression body 7 may be closed or open, and partially or completely interlinked. These voids may be extended lengthwise, have a cylindrical or prismatic shape, or be arranged such that their longitudinal axes are parallel to each other and preferably run at right angles to the axis of the compressive load. This approach results ins a compression body 7 having a honeycomb structure.

In a first embodiment, compression body 7 is composed of a porous metal foam, preferably, however, of steel foam, and can be fabrication based on the method described in DE-C-197 16 514. Bodies composed of metal foam and their fabrication are also described in WO-A-00/55567.

In another embodiment, compression bodies 7 contain cement, blown-glass particles, e.g., blown-glass granulate, and reinforcement elements of steel, plastic or glass. Here the reinforcement elements may be employed in the form of fibers, lattices, nets, rods, or plates, and with or without openings. The blown-glass particles becomes fixed within the matrix of the voids. Compression bodies 7 particularly suitable for use according to the invention are fabricated out of the following components per $m^3$:

cement: 1,000-1,300 kg
water: 390-410 kg
glass foam: 140-180 kg
superplasticizer: 10 l
steel fibers: 90-120 kg The following products are suitable for use as components of this mixture:

cement: portland silicate powder cement "Fortico 5R; supplier: Holcim (Switzerland) AG, Zurich;
glass foam: "Liaver" with a granulation of 2-4 mm and a particle density of approximately 0.3 g/$cm^3$; supplier: Liaver Ilmenau, Germany;
hyperplasticizer: "Glenium AC20"; supplier: Degussa Construction Chemicals AG, Zurich;
steel fibers: "DRAMIX RC-65/35-BN steel fibre"; supplier: Dramix, Belgium.

Particles composed of another suitable material, e.g., plastic or steel foam, may also be employed to form the voids in place of blown-glass particles. It is also possible to employ a combination of one or more of these materials. It is possible, for example, to use Styropor granules. The voids may also be formed by using a foaming agent which generates gas bubbles during fabrication of compression body 7. Whereas blown-glass particles provide a certain resistance against the compression of compression body 7, this is certainly not the case for Styropor granules.

In addition, it is also possible to employ a plastic, for example, synthetic resin in place of cement as the base material.

Figure 3:
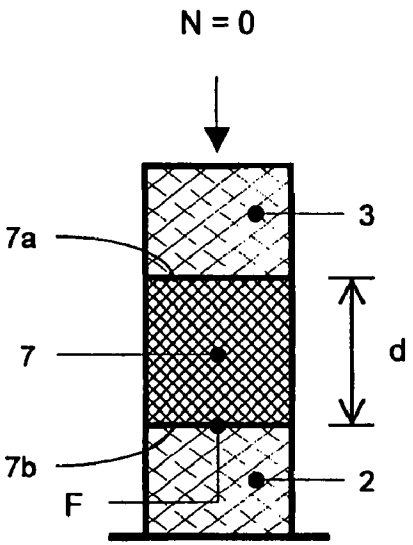
FIGS. 3 and 4 show a region of the tunnel lining with the compression body in the unloaded or loaded states in a view corresponding to that of FIG. 2.
Figure 4:
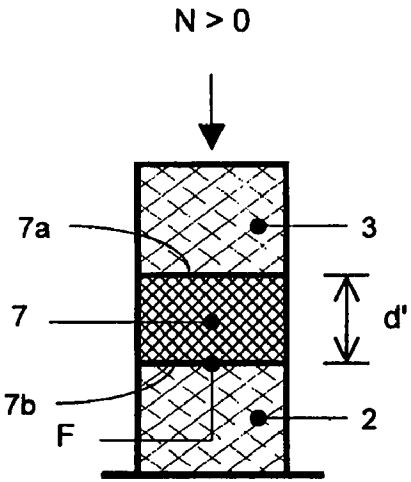
Figure 5:
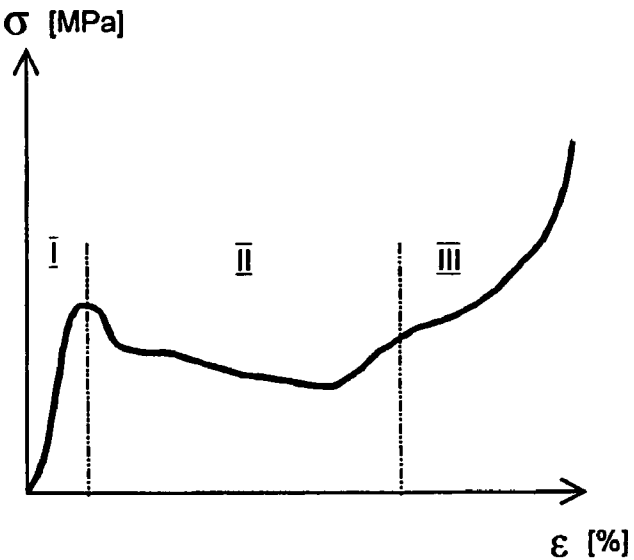
FIG. 5 is a diagram showing a possible compression behavior of the compression body.

The following discussion uses FIG. 3 through 5 to explain the functional principle of tunnel lining 1 shown in FIGS. 1 and 2.

FIGS. 3 and 4 show a region of the tunnel lining with compression body 7 in the unloaded or loaded state, where the compressive force acting on compression body 7 is designated as N, the body's cross-sectional area is designated as F, and the height of compression body 7 in the unloaded state is designated as d, and in the loaded state as d'. FIG. 5 shows a graph in which the compression e for compression body 7 ($\epsilon=(d-d')/d$) is indicated on the horizontal axis, and the compressive stress $\delta$ within compression body 7 ($\delta=N/F$) is indicated on the vertical axis.

Deformations in rock 5 cause a reduction in the profile of tunnel cavity 4, with the result that tunnel lining elements 2, 3 are subject to compressive forces and begin to shift relative to each other. At the same time, compressive stresses are generated in compression bodies 7 which result in a compression of compression bodies 7. When compression bodies 7 first experience the load, their compression E proceeds essentially linearly with increasing compressive stress $\delta$ (region I in FIG. 5). Upon reaching a given compressive stress $\delta$, the formation of cracks begins in compression bodies 7, as does a stepwise collapse or plastic deformation of the voids of compression bodies 7 (region II in FIG. 5). Tunnel lining elements 2, 3 gradually give way under the growing load and shift towards each other while reducing the size of space 6. Compression elements 7 are compressed at an increasingly higher rate. As FIG. 5 shows, the compressive stress in region II remains here at a relatively high level. Subsequently, there is a phase of increasing solidification as a result of the more efficient transfer of pressure, along with a decreasing volume for the voids (region III in FIG. 5).

In the embodiment shown in FIGS. 1 through 4, compression bodies 7 are located between tunnel lining elements 2, 3, without being additionally connected to lining elements 2, 3. The pressure-loaded surfaces 7*a*, 7*b* of compression elements 7 which each contact respective adjoining tunnel lining elements 2, 3 here run parallel to each other. In order to prevent compression elements 7 from being forced out of space 6 in response to a compressive load, these surfaces 7*a*, 7*b* may also be arranged obliquely relative to each other, i.e., arranged so as to form an angle. Compression elements 7 then have a wedge shape. Compression elements 7 are installed in space 6 such that surfaces 7*a*, 7*b* diverge in the direction of rock 5.

Figure 8:
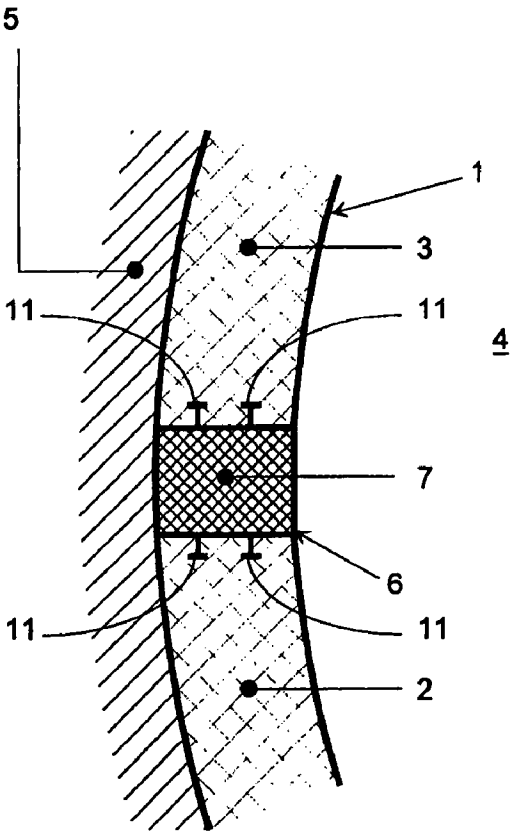
FIGS. 6 through 8 shows various connections between the compression body and the adjoining tunnel lining elements in a view corresponding to that of FIG. 2.
Figure 7:
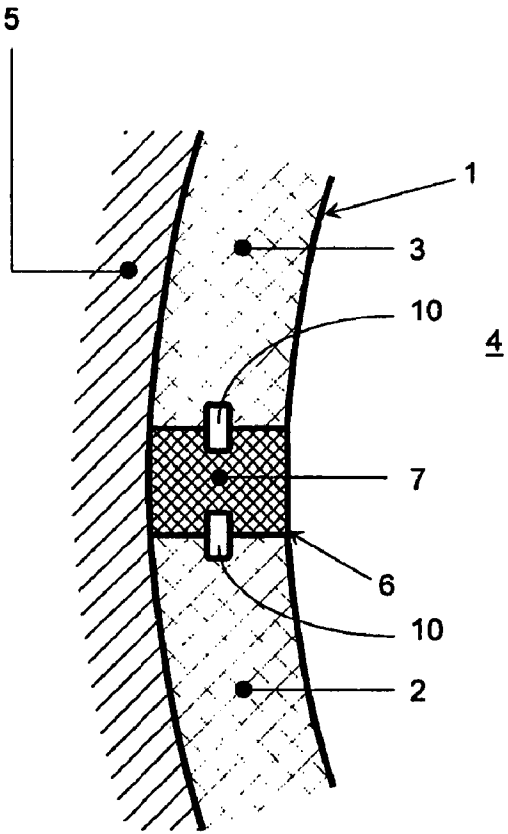
Figure 6:
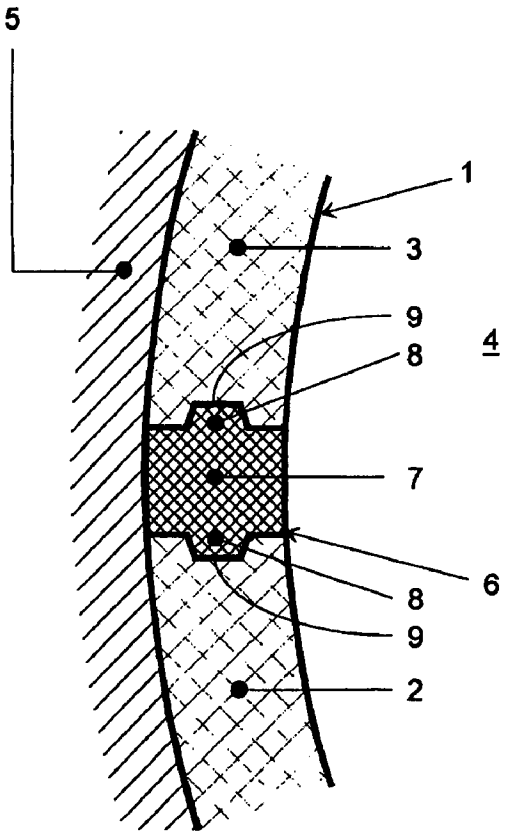

FIGS. 6 through 8 show various techniques for additionally connecting compression bodies 7 to the respective lining elements 2 or 3.

FIG. 6 shows a slot-and-key connection in which compression body 7 is provided with projecting strips 8 which engage recesses 9 in lining elements 2 or 3. It is also possible to locate the recesses on compression body 7 and the strips on tunnel lining elements 2, 3.

In the embodiment shown in FIG. 7, the connection between compression body 7 and lining element 2, 3 is effected by bolts 10 which are located in an offset arrangement in the longitudinal direction of space 6, i.e., in the longitudinal direction of the tunnel.

In the variant of FIG. 8, head bolts 11 also distributed in the longitudinal direction of the tunnel create the connection between compression bodies 7 and tunnel lining elements 2, 3.

Figure 10:
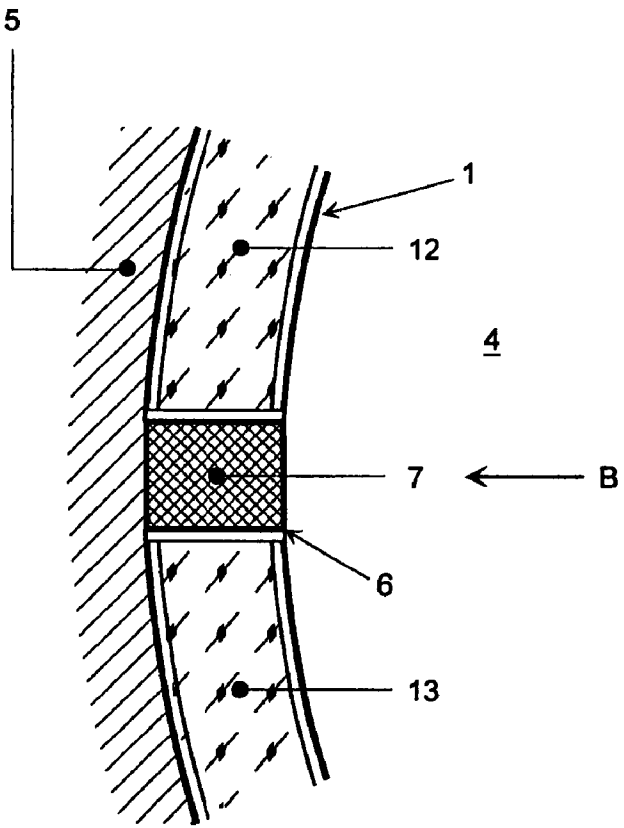
FIG. 10 is a section along line X-X in FIG. 9.
Figure 9:
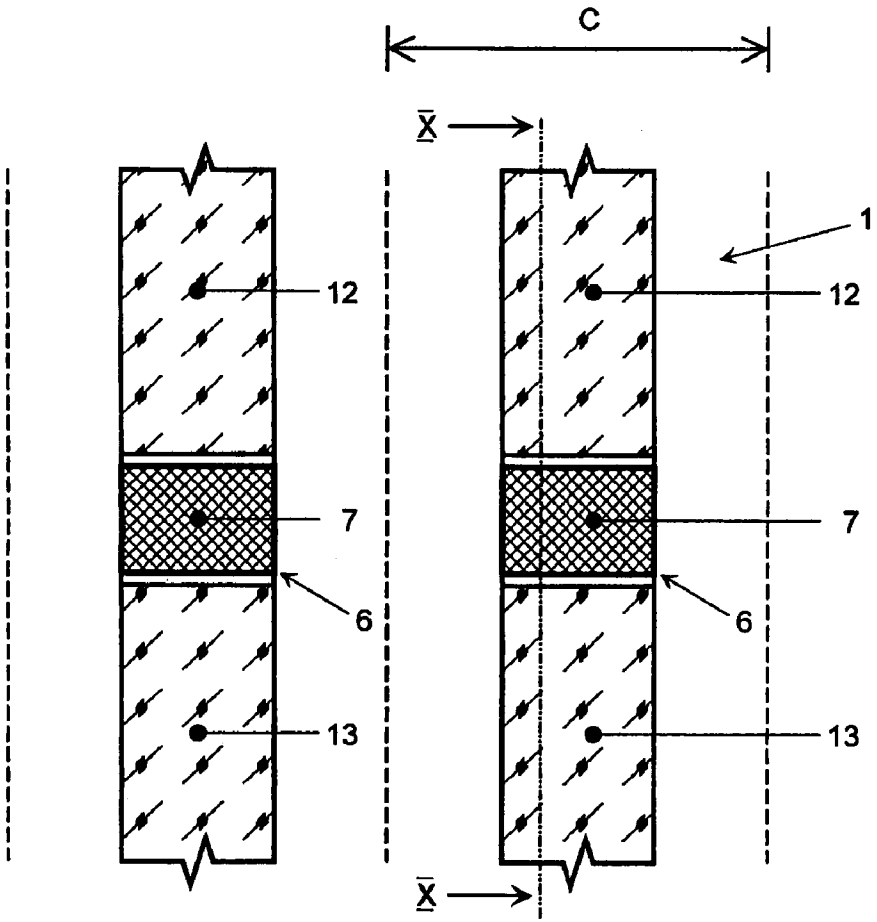
FIG. 9 is a view of a region of a second embodiment of a tunnel lining in the direction of arrow B in FIG. 10.

In the second embodiment shown in FIGS. 9 and 10, steel girders 12 and 3 are used as supporting means in place of tunnel lining elements 2, 3, the steel girders being installed at predetermined intervals in the longitudinal direction of the tunnel (see FIG. 9).

Interacting steel girders 12, 13 are separated by a space 6 in a manner analogous to the embodiment of FIGS. 1 and 2, into which space one compression body 7 each is inserted. In their structure and functional principle, these compression bodies 7 correspond to compression bodies 7 described for FIGS. 1 through 5, but have simply been adapted in form to somewhat different size conditions.

Figure 11:
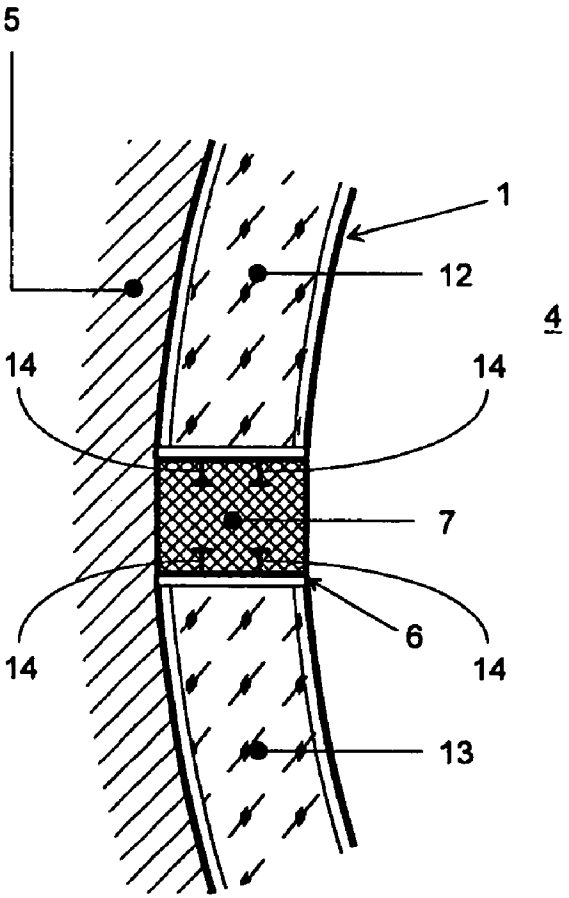
FIG. 11 shows the connection between the compression body and the adjoining steel girders in a view corresponding to that of FIG. 10.

FIG. 11 shows a technique for connecting compression bodies 7 to contiguous steel girders 12, 13. This connection is secured by head bolts 14 located in an offset arrangement in the longitudinal direction of the tunnel.

Figure 12:
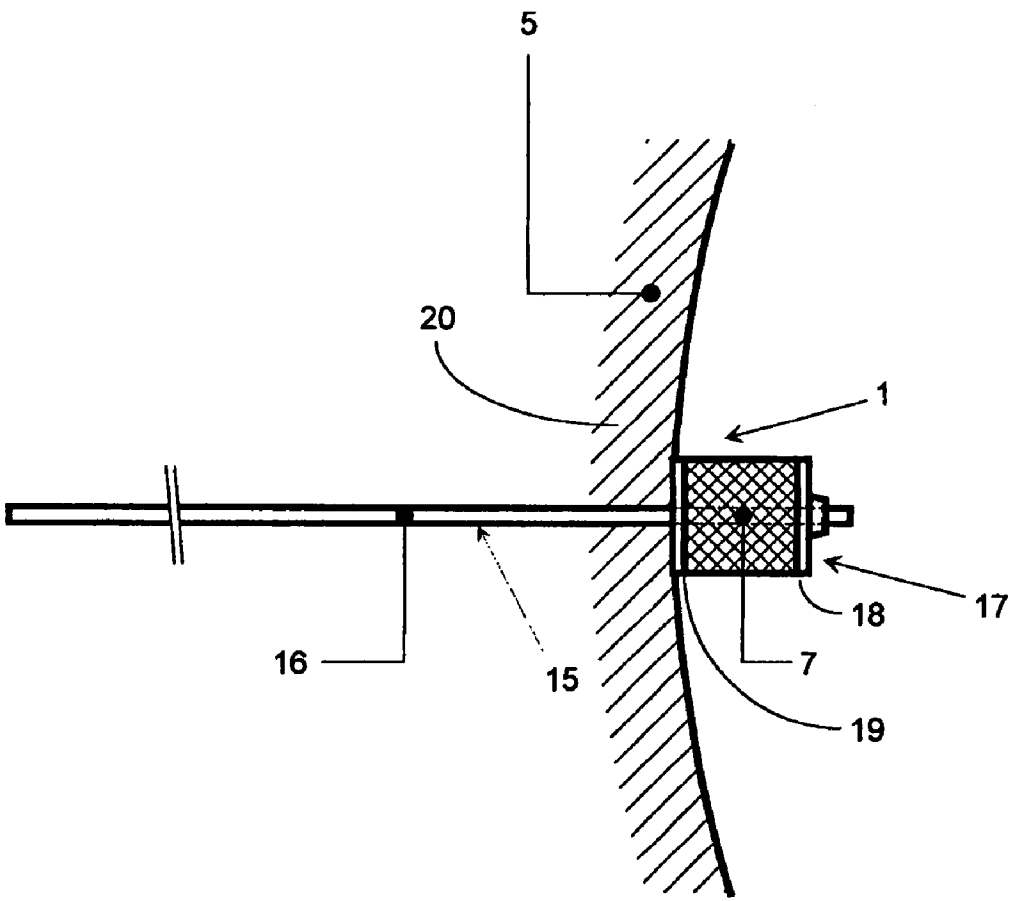
FIG. 12 shows a region of a third embodiment of a tunnel lining in a sectional view corresponding to those of FIGS. 2 and 10.

In FIG. 12, a third embodiment of a tunnel lining is described in which anchors 15 fixed in rock 5 are employed. FIG. 12 shows only one of these anchors. Anchor 15 is solidly anchored together with its anchor rod 16 within rock 5, e.g., either mechanically or by means of mortaring. Compression body 7 is installed in tunnel anchor head 17 projecting into tunnel cavity 4, which anchor head is solidly connected to anchor rod 16, this compression body corresponding to the compression body described for FIGS. 1 through 5. Compression body 7 is located between two steel disks 18 and 19.

When the wall region 20 adjoining tunnel cavity 4 moves relative to anchor rod 16 which projects deeply into rock 5, compression body 7 is deformed by the compressive forces acting thereon, i.e., it is compressed. As was explained based on FIG. 3 through 5, a certain relative movement between anchor rod 16 and wall region 20 is enabled without anchor 15 being subject to an excessive mechanical load able to destroy the anchor.

It may be desirable to have the stepwise collapse or compression of the voids within compression body 7 under load proceed in a very well-defined, controlled manner. This type of controlled behavior by compression body 7 under compressive load can be achieved by generating a nonhomogeneous stress condition in compression bodies 7 by forming compression bodies 7 appropriately, or by means of appropriate measures during their fabrication, e.g., by providing weak spots.

Compression bodies 7 may also be provided with at least one plate-like or lattice-like reinforcement element which runs transversely, and preferably at right-angles to, the direction of the load (effective direction of compressive force N in FIGS. 3 and 4). This reinforcement element, which has high mechanical strength, can be imbedded in the base material of compression body 7. Preferably, however, compression body 7 is designed as a multilayer composite body in which one layer each from a sub-body composed of a material containing the voids alternates with one plate-like or lattice-like reinforcement element. Use of the reinforcement elements enables the compression behavior of compression body 7 to be positively modified under compressive load.

It is of course obvious that the above-described supporting means or linings 1 can be employed not only in tunnel construction, but quite universally in underground construction.

LIST OF NUMBERS 1 tunnel lining
2,3 tunnel lining elements
4 tunnel cavity
5 rock
6 space
7 compression body; 7*a*, 7*b* compression-loaded surface
8 strip
9 recess
10 bolt
11 head bolt
12,13 steel girder
14 head bolt
15 anchor
16 anchor rod
17 anchor head
18,19 steel disk
20 wall region

What is claimed is:

1. A method for stabilizing a cavity excavated in underground construction, in which the cavity is secured by supporting means and the pressure exerted by the rock on the supporting means is directed through at least one compression body which deforms when a predetermined compressive load is exceeded, which body is composed of a material containing a predetermined volume fraction of voids, wherein a compression body is employed which contains blown-glass particles forming the voids and steel or plastic fibers as reinforcement elements, the blown-glass particles and the reinforcement elements being embedded in a cement binding means.

2. The method according to claim 1, wherein the compression body is employed having a compressive strength of at least 1 MPa, and a void fraction of between 10% and 90% of the total volume.

3. The method according to claim 2, wherein the compression body is employed having a compressive strength of at least 3 MPa, and a void fraction of between 20% and 70% of the total volume.

4. The method according to claim 1, wherein steel fibers are employed as reinforcement elements.

5. The method according to claim 1, wherein the compression body is employed having at least one installed reinforcement element being a plate or lattice.

6. The method according to claim 5, wherein a compression body being a multiplayer composite body is employed.

7. The method according to claim 1, wherein the cavity is secured by means of at least two supporting means which are displaceable relative to each other under the pressure exerted by the rock, which supporting means are separated by at least one space running in the longitudinal direction of the cavity wherein at least one compression body is inserted into this space which body is compressed or squeezed together in response to a relative motion of the supporting means.

8. The method according to claim 1, wherein the cavity is secured by at least one anchor fixed within the rock, wherein at least one compression body is inserted in the head of the anchor, which body is compressed or squeezed together relative to the rod of the anchor in response to a movement of the wall region of the cavity.

9. A device for stabilizing a cavity excavated in underground construction, comprising supporting means to secure the cavity, and at least one compression body, which body deforms in response to the compressive load exerted by the rock on the supporting means when a predetermined compressive load is exceeded, and which body is composed of a material containing a predetermined volume fraction of voids, the compression body containing blown-glass particles forming the voids and steel or plastic fibers as reinforcement elements, the blown-glass particles and reinforcement elements being embedded in a cement binding means.

10. The device according to claim 9, wherein the compression body has a compressive strength of at least 1 MPa, and void fraction of between 10% and 90% of its total volume.

11. The device according to claim 10, wherein the compression body has compressive strength of at least 3 MPa, and a void fraction of between 20% and 70% of its total volume.

12. The device according to claim 9, wherein steel fibers are employed as reinforcement elements.

13. The device according to claim 9, wherein the compression body is provided with at least one reinforcement element designed as a plate or lattice.

14. The device according to 13, wherein the compression body is a multiplayer composite body.

15. The device according to claim 9, comprising at least two supporting means which are displaceable relative to each other under the pressure exerted by the rock and intended to secure the cavity, which supporting means are separated by at least one space running in the longitudinal direction of the cavity to be secured, wherein at least one compression body is inserted into this space, which body is compressed or squeezed together in response to a relative motion of the supporting means.

16. The device according to claim 9, comprising at least one anchor which is fixable within the rock and intended to secure the cavity (4), wherein at least one compression body is inserted in the head of the anchor, which compression body is compressed or squeezed together in response to a movement of the wall region of the cavity relative to the rod of the anchor.

17. A compression body for a device according to claim 9 which is composed of a material containing a predetermined volume fraction of voids and which contains the blown-glass particles forming the voids and the steel or plastic fibers as reinforcement elements, the blown-glass particles and reinforcement elements being embedded in a cement binding means.

18. The compression body according to claim 17, wherein the body has a compressive strength of at least 1 MPa, and a void fraction of between 10% and 90% of its total volume.

19. The compression body according to claim 18, wherein the body has a compressive strength of at least 3 MPa, and a void fraction of between 20% and 70% of its total volume.

20. The compression body according to claim 17, wherein steel fibers are employed as reinforcement elements.

21. The compression body according to claim 17, wherein the body is provided with at least one installed reinforcement element being a plate or lattice.

22. The compression body as claimed in claim 17, wherein the compression body is a multiplayer composite body.

* * * * *